United States Patent [19]

Narita et al.

[11] 4,188,517

[45] Feb. 12, 1980

[54] COLLISION DETECTING INERTIA SWITCH

[75] Inventors: Seiichi Narita, Toyohashi; Norio Kumita, Kariya, both of Japan

[73] Assignee: Nippondenso Co., Ltd., Kariya, Japan

[21] Appl. No.: 936,097

[22] Filed: Aug. 23, 1978

[30] Foreign Application Priority Data

Sep. 23, 1977 [JP] Japan ..... 52-128653[U]

[51] Int. Cl.[2] ..... H01H 35/10

[52] U.S. Cl. ..... 200/61.45 R; 200/61.48

[58] Field of Search ..... 200/61.45 R, 61.46, 200/61.48, DIG. 45, 61.52

[56] References Cited

U.S. PATENT DOCUMENTS

| | | | |
|---|---|---|---|
| 2,747,041 | 5/1956 | Thomson | 200/61.46 |
| 2,747,699 | 5/1956 | Lucien | 200/61.46 X |
| 3,527,907 | 8/1970 | Schwab | 200/61.45 R |
| 4,022,997 | 5/1977 | Inagaki et al. | 200/61.48 X |
| 4,104,493 | 8/1978 | Hibino et al. | 200/61.45 R |

*Primary Examiner*—James R. Scott

*Attorney, Agent, or Firm*—Cushman, Darby & Cushman

[57] ABSTRACT

An apparatus for detecting a collision of a vehicle of the like has a main body which includes a rotational member comprising an eccentric weight member and two cam members, a spiral spring member which is deformed and applies a counteracting rotational force to the rotational member in response to the occurrence of impactive acceleration or deceleration of a vehicle or the like when the magnitude of the acceleration or deceleration exceeds a predetermined value, contact which is actuated by the two cam members to be opened or closed when the rotational member rotates against the countertorque by the spiral spring member to reach a predetermined angle of rotation, a base assembly, and a lid member. The collision detecting apparatus is completed by enclosing the abovementioned main body in a case with a retaining spring member intervening therebetween.

6 Claims, 3 Drawing Figures

FIG. 1a
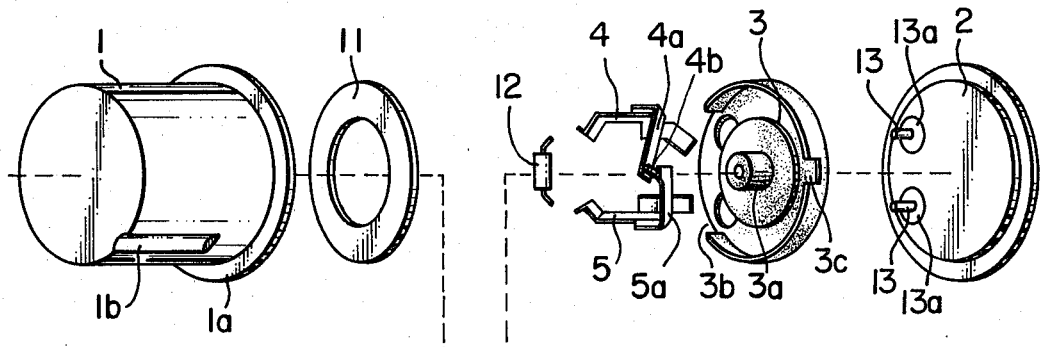
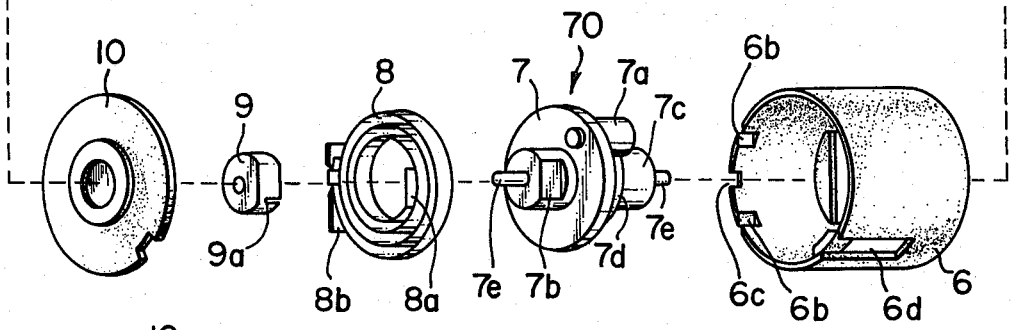
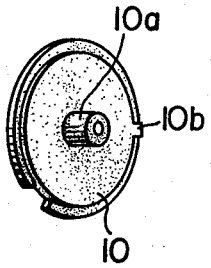
FIG. 1b
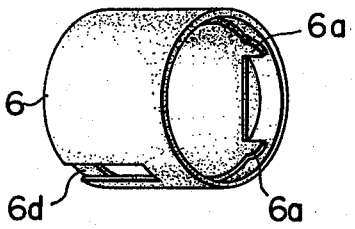
FIG. 1c

COLLISION DETECTING INERTIA SWITCH

BACKGROUND OF THE INVENTION

1. Field of the Invention

The present invention relates to a collision detecting apparatus which detects a collision of a vehicle or the like to actuate a driver or passenger protecting apparatus such as an air-bag or the like.

2. Description of the Prior Art

There have hitherto been proposed various collision detecting apparatuses which are interposed between a power supply and a driver or passenger protecting apparatus installed on a vehicle in order to actuate the driver or passenger protecting apparatus by generating a signal in an emergency such as a collision of the vehicle and supplying an electric current to the driver or passenger protecting apparatus from the power supply. It is known that such collision detecting apparatuses comprise a weight whose movement is caused mainly by the effect of acceleration to open or close an electrical contact. It is required that such collision detecting apparatuses surely supply an electric signal caused by the opening or closing of the electrical contact to the outside thereof and at the same time have a simple construction so that they may be manufactured with an easy assembly operation.

However, there has been a problem that conventional apparatuses, which in order to provide a stable signal and to be relatively free from malfunction, have a complicated construction which causes reliability and at the same time requires a difficult assembly operation.

SUMMARY OF THE INVENTION

A first object of the present invention is to provide a collision detecting apparatus comprising a rotational member having a weight positioned eccentrically from the center axis of a shaft, which supports the rotational member, two cam members which rotate synchronously with the rotational member, and electrical contact elements actuated by the two cam members, respectively, thereby enabling sure operation of the electrical contact mechanism as a signal source, maintaining a constant gap between the paired electrical contacts and preventing malfunction from being caused by mechanical vibration, etc., thus assuring highly reliable contacting performance of the electrical contacts.

A second object of the present invention is to provide a collision detecting apparatus for a vehicle or the like, in view of the aforesaid problem, in which a case and an end plate form an enclosed space, a cylindrical housing is installed within the enclosed space, a rotational member, which rotates in response to acceleration or deceleration caused by a collision of the vehicle or the like, is supported in the housing, both end openings of the housing are closed with a lid member and a base member, respectively, and an elastic member intervening between the case and the lid member presses and holds the respective component parts by its elastic force, thereby providing a construction which includes a smaller number of component parts and easily enables the unidirectional assembly of the collision detecting apparatus with an automatic assembly machine.

The present invention can provide a highly reliable collision detecting apparatus which comprises a rotational member having a weight positioned eccentrically from the center axis of a shaft, which supports the rotational member, and a spring member connected to the rotational member to counteract its rotational movement, two cam members which rotate synchronously with the rotational member, and an electrical contact mechanism with its spring arms, which carry electrical contacts, respectively, touching the respective cam members, thereby preventing malfunction from being caused by mechanical vibration, etc. and assuring reliable opening or closing operation of the electrical contacts. Further, the present invention brings a remarkable advantage such that the selection of the cam profiles of the cam members makes it possible to determine exactly a length of the gap between the paired electrical contacts and to render the closing time of the paired electrical contacts sufficiently long as desired.

Furthermore, since the collision detecting apparatus of this invention has a construction such that the apparatus can be assembled by supplying necessary component parts from one side in the axial direction, it is possible to assemble the apparatus in a short time by using an automatic machine. The apparatus may also be constructed using a simple assembly operation which does not require skilled labour. Thus, the present invention has a great advantage to provide a collision detecting apparatus of the type to detect a collision of a vehicle or the like by the rotational movement of a rotational member which is of low price but has excellent collision detecting capability.

BRIEF DESCRIPTION OF THE DRAWING

FIG. 1(*a*) is a perspective general-assembly drawing showing an embodiment of the collision detecting apparatus according to the present invention;

FIG. 1(*b*) is an alternate perspective view of the lid shown in FIG. 1(*a*);

FIG. 1(*c*) is an alternate perspective view of the housing shown in FIG. 1(*a*);

DESCRIPTION OF THE PREFERRED EMBODIMENT

Figure 2:
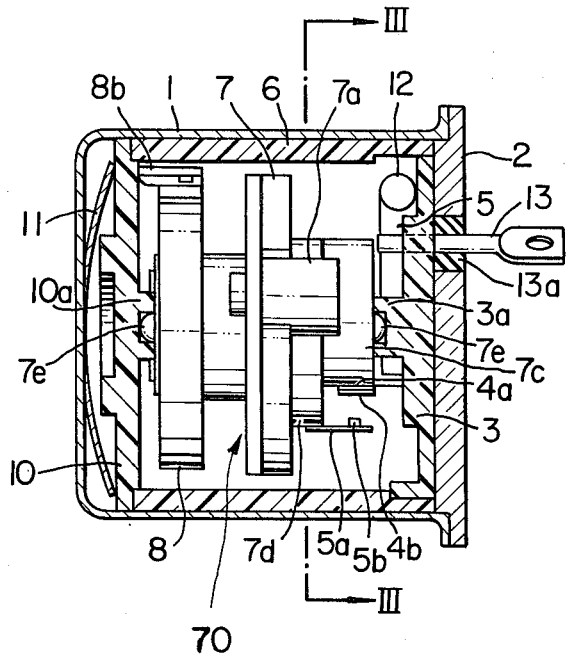
FIG. 2 shows a longitudinal section of the collision detecting apparatus according to the present invention shown in FIG. 1 but in the assembled state.

The present invention will be described hereunder with reference to the accompanying drawings which illustrate a preferred embodiment of the present invention.

Referring to FIGS. 1(*a*), 1(*b*), 1(*c*), 2 and 3, reference numeral 1 designates a cup-like case made of iron having a nickel-plated surface, a flanged end portion 1*a* which is to be joined to an end plate 2 by a ring-projection welding method, and an embossed portion 1*b* which engages with a slot 6*d* of a housing 6 to prevent the rotational shift of the latter. The end plate designated by the reference numeral 2 is made of iron and its peripheral portion is joined later to the flanged end portion 1*a* of the case 1 by a ring-projection welding method thereby to provide a completely sealed space within the case 1. Reference numeral 3 designates a base made of a resin material which has a bearing portion 3*a* for rotatably supporting a shaft 7*e*, which supports a rotational member 70 of the collision detecting apparatus, and a notch 3*b* in which projections 6*a* of the housing 6 are fitted. Reference numerals 4 and 5 designate electrical contact members to be fixed to the base 3 by a method of caulking with preheating, etc. The electrical contact members 4 and 5 have leaf spring portions 4*a* and 5*a*, respectively, which touch cam members 7*c* and 7*d* of the rotational member 70, respectively. The cam members 7*c* and 7*d* are made of an insulating material. The end portions of the leaf spring portions 4*a* and 5*a* carry electrical contacts 4*b* and 5*b* which have been spot-welded thereto, respectively. The housing designated by the reference numeral 6 is made of a resin material, and comprises the abovementioned projections 6*a* which are fitted into the notch 3*b* of the base 3, slit portions 6*b* to which an outer end portion 8*b* of a spiral spring 8 is fixed, a notch 6*c* in which a projection 10*b* of a lid 10 made of a resin material is fitted, the abovementioned slot 6*d* which engages with the embossed portion 1*b* of the case 1 to prevent the rotational shift of the housing 6 itself, and stopper portions 6*e* and 6*f* which define the range of the angle of rotation of the rotational member 70.

Further, the stopper portion 6*e* determines the home position of a weight 7*a*, which is eccentrically attached to a wheel 7 of the rotational member 70, and hence the maximum angle of rotation of the weight 7*a* which may be reached when a collision takes place. The rotational member 70 comprises the wheel 7, the weight 7*a* eccentrically attached thereto, a fixing portion 7*b* for fixing an inner end portion 8*a* of the spiral spring 8 thereto by means of a cap 9, and the cam members 7*c* and 7*d* which make the electrical contacts 4*b* and 5*b* of the electrical contact members 4 and 5, respectively, contact each other when the rotational member 70 rotates to exceed a predetermined angle of rotation. Here, the cam members 7*c* and 7*d* may be incorporated with the wheel 7 forming a single body. Both ends of the shaft 7*e* are supported rotatably by the bearing portion 3*a* of the base 3 and a bearing portion 10*a* of the lid 10, respectively, and further the shaft 7*e* and the rotational member 70 are held in freely rotatable engagement with each other.

The spiral spring designated by the reference numeral 8 urges the weight 7*a* of the rotational member 70 against the stopper portion 6*e* of the housing 6 to maintain the weight 7*a* normally in its home position. The cap designated by the reference numeral 9 fixes the inner end portion 8*a* of the spiral spring 8 to the fixing portion 7*b* of the rotational member 70, as above mentioned, and has a slit 9*a* for holding the inner end portion 8*a* of the spiral spring 8 therein. The lid designated by the reference numeral 10 has the bearing portion 10*a* for rotatably supporting the shaft 7*e* and the projection 10*b* which is fitted into the notch 6*c* of the housing 6 to thereby prevent the occurrence of misadjustment when combining the lid 10 with the housing 6. Reference numeral 11 designates a retaining spring member shown as a wave washer which is an elastic member used to press the base 3, the housing 6 and the lid 10 toward the end plate 2. Reference numeral 12 designates a resistor fixed to the electrical contact members 4 and 5 by soldering. The resistor 12 is used to provide an electric path which allows a small electric current to flow therethrough even when contact is not established between the electrical contacts 4*b* and 5*b*, which serves for the purpose of checking the operation of an external electric circuit associated with the collision detecting system. Reference numeral 13 designates electric terminal pins for external connection which are fixed to the end plate 2 with an insulating material 13*a* intervening therebetween and which are also connected to the respective electrical contact members 4 and 5 by soldering.

The operation of the collision detecting apparatus having the abovedescribed construction will be explained hereinafter.

Figure 3:
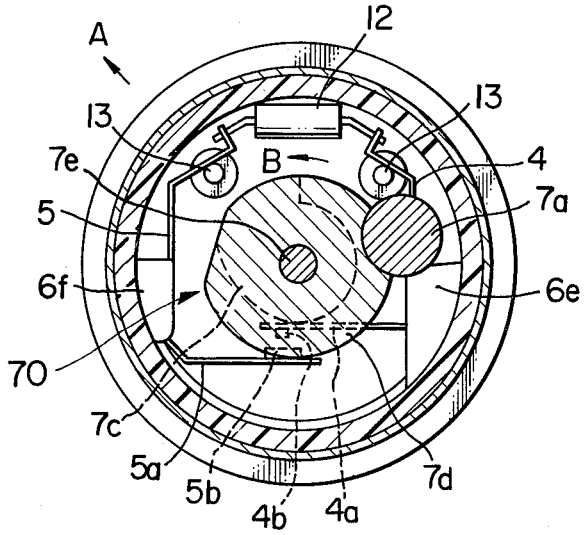
FIG. 3 is a cross-sectional view of the collision detecting apparatus according to the present invention shown in FIG. 2 as viewed in the direction of arrows along the cutting-plane line III—III.

When there occurs a collision of a vehicle or the like having the collision detecting apparatus of the present invention mounted thereon in the direction of an arrow A shown in FIG. 3 and a deceleration force is applied to the collision detecting apparatus, the rotational member 70 having a center of mass shifted by the weight 7*a* eccentrically from the center axis of the shaft 7*e* will tend to start its rotation in the direction of an arrow B shown in FIG. 3. If the acceleration or deceleration of the collision detecting apparatus caused by an impact exceeds a predetermined value, the rotational member 70 will be given a forward torque to overcome an initial countertorque load set by the spiral spring 8. When the rotational member 70 starts to rotate, the two cam members 7*c* and 7*d* also rotate in the direction of the arrow B, which causes the cam member 7*c* to push the leaf spring portion 4*a* of the electrical contact member 4 away from the shaft 7*e* and causes the cam member 7*d* to allow the leaf spring portion 5*a* of the electrical contact member 5 to lean toward the shaft 7*e*. When the rotational member 70 has rotated to exceed a predetermined angle of rotation, the electrical contacts 4*b* and 5*b* are brought into contact with each other to establish electrical conduction therebetween and thereby generate a collision signal. On the other hand, if the acceleration or deceleration of the collision detecting apparatus, which occurs when the vehicle or the like travels on a rough road or when sudden braking is applied, does not exceed a predetermined value, the rotational movement of the rotational member 70 remains restrained by the spiral spring 8 and is not allowed to reach the predetermined angle of rotation, and hence electrical conduction can not be produced between the electrical contact members 4 and 5.

Next, the process of assembling the abovedescribed collision detecting apparatus embodying the present invention will be explained.

Firstly, the base 3 is attached to the end plate 2 which has the electric terminal pins 13 fixed thereto, and the electrical contact members 4 and 5 are fixed to the base 3, and then the resistor 12 is fixed to the electrical contact members 4 and 5. Thus the base assembly is completed. Next, the housing 6 is combined with the base assembly with the projections 6*a* thereof fitted into the notch 3*b* of the base 3. The spiral spring 8 is beforehand fixed to the fixing portion 7*b* of the rotational member 70 at the inner end portion 8*a* of the spiral spring 8. Then, the rotational member 70 is joined to the combination of the housing 6 and the base assembly by inserting one end of the shaft 7*e* in the bearing portion 3*a* of the base 3, adjusting the weight 7*a* of the rotational member 70 to abut against the stopper portion 6*e* of the housing 6 and fixing the outer end portion 8*b* of the spiral spring 8 to the housing 6 at its slit portions 6*b*. Next, the lid 10 is set onto the lastmentioned combination by making the bearing portion 10*a* of the lid 10 engage with the shaft 7*e*, with the other end of the shaft 7*e* being inserted in the bearing portion 10*a*, and by fitting the projection 10*b* of the lid 10 into the locating notch 6*c* of the housing 6. Thus, the assembly of the main body of the apparatus is completed which comprises a housing assembly and the rotational member 70 supported by the shaft 7*e* within the housing assembly. Lastly, the case 1 is put on the housing assembly, which contains the rotational member 70 therein, to cover the housing assembly with the wave washer 11 intervening between the inner bottom surface of the case 1 and the outer surface of the lid 10 of the housing assembly and acting as an elastic member for pressing the lid 10, the housing 6 and the base 3 toward the end plate 2. Thereafter, as mentioned before, the flanged end portion 1*a* of the case 1 and the peripheral portion of the end plate 2 are joined together by a ring-projection welding method.

As explained hereinabove, the collision detecting apparatus of this invention has a construction which enables the assembly thereof to be carried out smoothly and surely in one direction, namely, in the direction of the center axis of the shaft 7*e* and therefore facilitates the assembly thereof with an automatic machine.

In addition, it should be noted that the present invention is not restricted to the abovedescribed single embodiment. Namely, the rotational member 70, the shaft 7*e* and the bearing portions 3*a* and 10*a* have been described to be in freely rotatable engagement with one another in the abovedescribed embodiment. However, it must be understood that the present invention covers other cases: where the rotational member 70 and the shaft 7*e* are fixed to each other, while the shaft 7*e* remains in freely rotatable engagement with the bearing portions 3*a* and 10*a;* and where the shaft 7*e* and the bearing portions 3*a* and 10*a* are fixed to one another, while the rotational member 70 remains in freely rotatable engagement with the shaft 7*e*. Further, the wheel 7 has been described to be a disk in the abovedescribed embodiment, however, it does not necessarily follow that the wheel 7 is a disk. Namely, the shape of the rotational member 70 does not matter if only the rotational member 70 is constructed to have a predetermined magnitude of moment of inertia and to comprise an eccentrically positioned weight of a predetermined weight value.

In addition, the electrical contacts 4*b* and 5*b* have been described to close when the rotational member 70 rotates to reach a predetermined angle of rotation in the abovedescribed embodiment, however, the contacts 4*b* and 5*b* may stay initially in a closed state and then be opened upon the rotation of the rotational member 70 to reach such an angle of rotation.

We claim:

1. A collision detecting apparatus comprising:

a housing assembly;

a rotational member rotatably supported by a shaft within said housing assembly, both ends of said shaft being supported by said housing assembly, said rotational member comprising a weight member positioned eccentrically from said shaft and cam members having cam profiles formed on peripheral surfaces thereof;

a spring member disposed within said housing assembly, one end of which spring member is fixed to said housing assembly and the other end of which spring member is fixed to a portion of said rotational member, thereby applying a counteracting rotational force to said rotational member depending on an angle of rotation through which said rotational member has rotated;

electrical contact means disposed within and fixed to said housing assembly and actuated by said cam members of said rotational member to be opened or closed when the rotation of said rotational member reaches a predetermined angle of rotation; and means for holding said housing assembly together.

2. A collision detecting apparatus according to claim 1, wherein said spring member includes a spiral spring member.

3. A collision detecting apparatus according to claim 1, wherein said cam members of said rotational member are made of an insulating material.

4. A collision detecting apparatus according to claim 2, wherein said holding means comprises a cup-like case member for sealing an inner space of said collision detecting apparatus in conjunction with said housing assembly.

5. A collision detecting apparatus according to claim 2, wherein said housing assembly comprises:

a base assembly having bearing means for rotatably supporting one end of said shaft and electric terminals connected electrically to said electrical contact means;

a cylindrical member having portions for holding one end of said spiral spring and stopper portions arranged on an inner surface thereof for defining the range of rotation of said rotational member; and a lid member having bearing means for rotatably supporting the other end of said shaft on an inner surface thereof;

said base assembly, cylindrical member and lid member being mutually interfitted.

6. A collision detecting apparatus according to claim 5 further comprising:

a retaining spring member inserted between an inner bottom surface of said case member and an outer surface of said lid member;

said holding means comprising a cup-like case member for sealing an inner space of said collision detecting apparatus in conjunction with said base assembly.

* * * * *